United States Patent [19]

Gray et al.

[11] Patent Number: 4,858,305

[45] Date of Patent: Aug. 22, 1989

[54] SINGLE STATION TENSION HAIRPIN TUBE EXPANDER

[75] Inventors: Kenneth P. Gray, Syracuse; Michael L. McDonough, Jamesville; Bruce J. Poplawski, Mattydale; Daniel P. Gaffaney, Chittenango; Ross A. Moyer, LaFayette, all of N.Y.

[73] Assignee: Carrier Corporation, Syracuse, N.Y.

[21] Appl. No.: 202,892

[22] Filed: Jun. 6, 1988

[51] Int. Cl.[4] ..... B23P 15/26

[52] U.S. Cl. ..... 29/727; 29/157.3 C; 29/157.4; 29/523

[58] Field of Search ..... 29/33 G, 33 T, 157.3 R, 29/157.3 B, 157.3 C, 157.4, 282, 283.5, 522.1, 523, 727; 72/306, 316, 317, 318, 370, 476

[56] References Cited

U.S. PATENT DOCUMENTS

| | | | |
|---|---|---|---|
| 1,791,887 | 2/1931 | Davies et al. | 72/318 |
| 2,016,795 | 10/1935 | Belknap | 72/318 |
| 2,620,013 | 12/1952 | De Voss | 72/318 |
| 3,119,435 | 1/1964 | Greenman | 72/318 X |
| 4,228,573 | 10/1980 | Barnard | 29/157.3 R |
| 4,584,751 | 4/1986 | Gray et al. | 29/157.3 C |
| 4,584,765 | 4/1986 | Gray | 29/727 |
| 4,720,902 | 1/1988 | Gray | 29/157.3 C |
| 4,745,678 | 5/1988 | Gray | 29/727 |
| 4,761,866 | 8/1988 | Murphy | 29/157.3 C |
| 4,766,667 | 8/1988 | Gray | 29/157.3 C X |

FOREIGN PATENT DOCUMENTS

| | | | |
|---|---|---|---|
| 133952 | 5/1985 | European Pat. Off. | 72/316 |
| 1602727 | 11/1981 | United Kingdom | 72/316 |

*Primary Examiner*—Mark Rosenbaum
*Assistant Examiner*—Frances Chin
*Attorney, Agent, or Firm*—Bernhard P. Molldrem, Jr.

[57] ABSTRACT

A single-station tube expander apparatus bells and expands the open ends of heat exchanger hairpin tubes in a plate-fin heat exchanger unit. A frame supports belling jaw fingers which close over and the open ends of the tubes so that a belling device can enter the tube ends to urge the tube outward into a profile surface formed in the mating faces of the fingers. Also on the frame are mounted expander jaw fingers which close over tube ends which have been belled previously, and hold the associated hairpin tubes against axial movement while expander rods pass into the associated tube legs to urge the hairpin tube legs outward to contact against the fin plates and tube sheets of the fin pack heat exchanger. The belling fingers and belling device move step by step from one tube to another, and the expander gripping fingers and expander rods follow the belling fingers and belling device.

6 Claims, 4 Drawing Sheets

SINGLE STATION TENSION HAIRPIN TUBE EXPANDER

BACKGROUND OF THE INVENTION

This invention relates to plate-fin heat exchangers, and is more particularly directed to apparatus for belling and expanding hairpin tubes into a fin pack.

Plate-fin type heat exchangers are often employed in air conditioning systems and refrigeration systems. These plate-fin units are typically formed by lacing hairpin tubes or U-tubes into aligned holes in a stack of fin plates and tube sheets, with the U-bend sections extending out one side of one of the tube sheets and the open ends of the hairpin tubes extending out the other tube sheet. The walls of the tube, which are typically copper, are then expanded radially into contact with the metal of the fin collars and the tube sheets, which establishes both good thermal contact and mechanical support. The hairpin tube open ends are belled, either before or after tube expansion, and return bends are soldered or brazed into the belled ends to close the flow circuit of the unit.

While the hairpin tubes can be supported from the U-bend side during expansion, i.e., a process known as compression expansion, such a technique is not preferred because of the tendency to bend the tubes, and also because of an uncertainty in establishing an offset distance between the open ends of the tubes and the tube sheet. A compression expansion technique is described in U.S. Pat. No. 4,228,573.

A tension-expansion technique involves belling the hairpin tubes prior to expansion and then supporting the tubes by their belled ends while expander rods are driven into the two legs of each hairpin tube. The tubes can be belled directly against the associated tube sheet so that the tube sheet supports the hairpin tubes during expansion, or else the bells can be formed at an established standoff distance above the tube sheet. In the latter case the belled ends can be supported in a clamping jaw or similar device during expansion. One technique for belling and expanding hairpin tubes in a plate-fin heat exchanger is described in U.S. Pat. No. 4,584,765.

To date, there has been no equipment or apparatus proposed which permits tension expansion of the hairpin tubes of a plate-fin heat exchanger and in which belling and expanding are carried out at a single station. Also, there has not been proposed a hairpin tube expander which permits the belled ends of the hairpin tubes to be offset a finite distance from the associated tube sheet. No apparatus has been proposed that permits belling and expanding of hairpin tubes where a tube sheet flange extends over the open ends of the hairpin tubes.

OBJECTS AND SUMMARY OF THE INVENTION

Accordingly, it is an object of this invention to expand tubes in a fin-pack heat exchanger while avoiding the drawbacks of the prior art.

It is another object of this invention to provide a technique for belling with a flare and expanding hairpin heat-exchanger tubes at a single station.

It is a further object of this invention to provide belling and expanding apparatus which can be controlled by a suitable stored program to expand the hairpin tubes of a fin-pack unit progressively, hairpin tube by hairpin tube.

It is a still further object of this invention to provide apparatus for tension expansion of heat exchanger tubes and which can accommodate forward facing end flanges of the heat exchanger tube sheets, and which can provide the required standoff so that the bells do not stand directly on the tube sheet, with belling and expanding being carried out simultaneously at a single work station.

According to one aspect of this invention, belling and expanding apparatus are provided to work within the restraints of a fin pack heat exchanger.

A frame is mounted in proximity to a support for holding a fin pack which is made up of U-tubes or hairpin tubes laced through a stack of perforated fin plates. The open ends of the hairpin tubes face the frame. The frame pivotally supports at least one pair of belling jaw fingers which swing toward or away from each other to grip or release a respective hairpin tube end. These jaw fingers have a profile surface that permits expansion of the tube end into a bell shape. As defined herein, the bell shape has a flared open end. A belling device also carried on the frame is inserted into the associated tube end between the closed-together belling jaw fingers. The belling device urges the tube end radially outward into the profile surface to bell and flare the tube end.

The frame also carries at least two pairs of expander jaw fingers, and preferably four pairs, which swing to clamp over the previously belled ends of adjacent legs of hairpin tubes in at least two rows. These fingers are closed and opened as appropriate to clamp the associated hairpin tubes for tension expansion into the fin pack.

Expander rods are associated with each of the pairs of expander jaw fingers and are also carried on the frame. These rods are driven between the associated expander jaw fingers into the associated hairpin tube legs to urge the tube legs radially outward into contact against the fin plates and tube sheets.

After a given hairpin tube has been expanded as above, the frame with its belling and expanding mechanisms is stepped or indexed laterally with respect to the fin pack, and the next adjacent tube ends are belled while another pair of belled hairpin tube legs are expanded.

The expander rods operate selectively and can be programmed for any hairpin tube pattern, so that both legs of a given hairpin tube will be expanded at the same time, or two adjacent parallel hairpins will be expanded at the same time.

The belling and expanding device steps in the rowwise direction one tube end at a time over the length of the tube sheet, and then can step or index to the next row and traverse that row. The device works within the constraints of a typical evaporator or condenser coil, which can have a wide flange on either side of each tube sheet.

The above and many other objects, features, and advantages of this invention will be more apparent from the ensuing detailed description of a preferred embodiment, when considered in connection with the accompanying Drawing.

DETAILED DESCRIPTION OF PREFERRED EMBODIMENT

Figure 1:
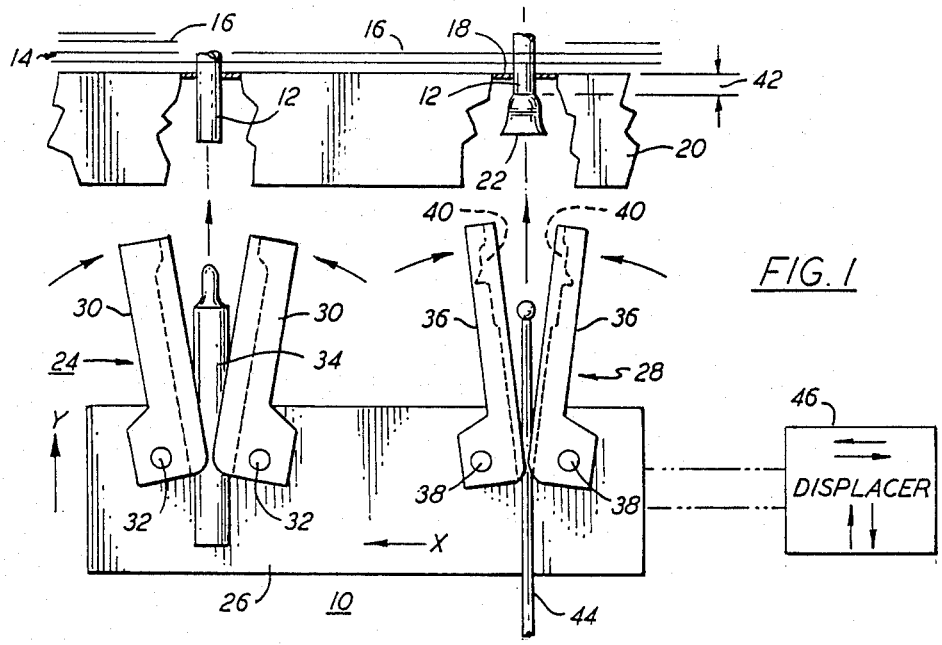
FIG. 1 is a schematic top plan view of belling and expanding apparatus according to an embodiment of this invention.
Figure 2:
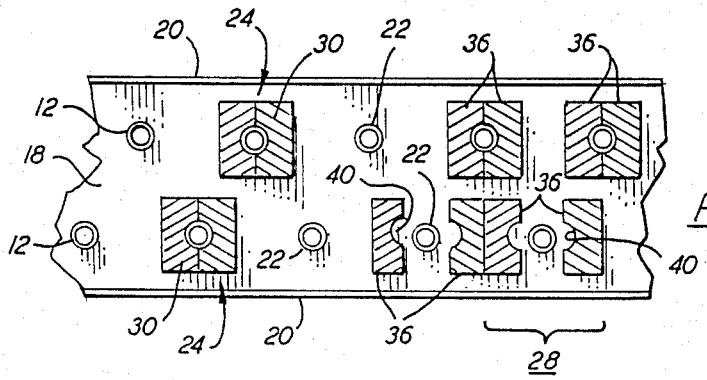
FIG. 2 is a schematic front elevation showing action of gripping jaw fingers of FIG. 1.
Figure 3:
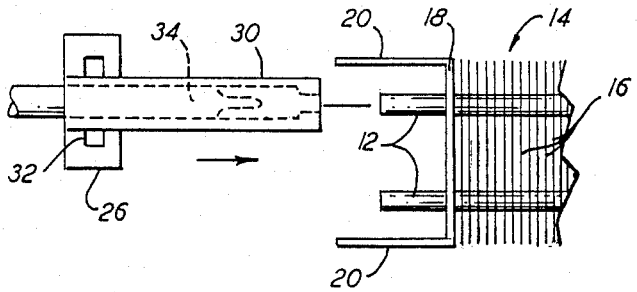
FIG. 3 is a schematic side elevation of the apparatus of FIG. 1.

With reference initially to FIGS. 1–3 of the Drawing, tube expander apparatus 10 are shown for belling and expanding open ends 12 of heat exchanger tubes, namely the legs of hairpin tubes in a plate-fin type heat exchanger 14. In the latter, a number of hairpins or U-tubes are laced into a stack of aligned fin plates 16, with a tube sheet 18 holding the assembly in place. Here, the tube sheet has a pair of flanges 20 which extend out beyond the open ends 12 of the hairpin tubes. The apparatus is arranged to form flared bells 22 on two hairpin tube ends 12 at a time, and to expand two or four adjacent tube legs, i.e., to expand one or two hairpin tube at a time.

In some heat exchanger coils, e.g., mobile use, the free ends 12 of the tubes are provided with an offset or standoff between the tube sheet 18 and the bells 22 in which return bends (not shown) are soldered or brazed.

In these heat exchangers, the tube sheet flanges 20 may face forwards, requiring an impact beller of a special design. Here, it is not possible to employ the beller of U.S. Pat. No. 4,584,765. The bell 22 must stand off from the tube sheet 18, and thus must be held by a gripper and not simply be supported only by the tube sheet during expansion. It is also desired to bell and expand the tube ends 12 at a single station because of space limitations and to minimize the handling and transfer of the fin pack units.

The apparatus includes superposed bellers 24,24 which are mounted on a frame or carriage 26 to traverse the tube sheet 18 and bell two tube ends 12 at a time. A four-tube expander 28 is also mounted on the carriage to follow the bellers 24 and expand the appropriate tube legs that correspond to one or two single hairpins.

The bellers 24 each comprise a pair of gripper fingers 30 that swing together on pivot pins 32. The fingers 30 reach under the tube sheet flanges 20 and open in a sideways direction (FIG. 1). As only two tubes are belled at any one time, and these in different rows, there is ample side clearance for finger opening. These beller jaw fingers 30 must be clamped with considerable force to clamp the smooth tube, and thus are made rather thick to prevent flexing due to their length. The mating faces of the fingers 30 are provided with a profile surface against which the metal of the tube ends 12 is expanded to form the end bells 22.

The beller jaw fingers 30 grip the tube ends 12 while a belling tool 34 advances between the fingers to form the bell 22. Here, the belling tool can be a two-stage device comprising a pinching bullet which enters the tube end 12 to expand it outward sufficiently to receive the return bend, and a flaring collar that enters the end to form a bell flare. This type of impact belling tool is described in greater detail in application Ser. No. 202894. After the bells 22 have been formed, the belling tool 34 is withdrawn and the fingers 30 are opened.

At the same time that a belling operation is taking place, the four-tube expander 28 carries on a tension-expanding operation. The expander 28 comprises two pairs of opposed expander jaw fingers 36 in each of two rows. These fingers 36 are mounted by pivot pins 38 onto the carriage 26 and each pair has a profiled cavity 40 formed on opposed mating faces. The bell 22 is held off from the tube sheet 18 a predetermined standoff distance 42, and an expander rod 44 associated with the pair of expander jaw fingers 36 enters the belled tube end 12 between the fingers 36. Here the expander jaw fingers 36 are thin in order to obtain sufficient side-to-side clearance. The required clamping force for these fingers 36 is comparatively low, as the reaction to the expansion force applied to the tube bell is primarily axial and the fingers grip the flared portion of the bell. These beller fingers 36 reach under the tube sheet flanges 20 and open in a sideways direction. Hairpin tubes are expanded by selecting and advancing expander rods 44 according to hairpin orientation. The rods 44 pass through the length of the legs of each hairpin tube to drive the same out into thermal and mechanical contact with the fin collars and tube sheets. Therefore, the rods 44 are withdrawn back out through the fingers 36, and the latter are opened. A displacer mechanism 46 (shown here schematically) pulls carriage 26 back slightly and then steps or indexes it sideways to the, position of the next tube ends 12. Thereafter the carriage advances towards the fin pack unit and the beller and expander jaw fingers 30 and 36 reach under the tube sheet flange 20 to grasp the next unbelled and belled tube ends 12, respectively. The belling and expanding operation is repeated across an entire row. The apparatus proceeds across each row and then the displacer 46 brings the apparatus to the next adjacent row.

If it is desired to place the bells 22 directly on the tube sheet 18, i.e., with a standoff distance 42 of zero, the gripper profile surfaces 34 for the belling jaw fingers 30 could be designed accordingly. Then, if it is desired to support the tubes directly by the tube sheet 18 during expansion, the fingers 36 could be omitted, or simply disabled during expansion.

The expander jaw fingers 36 are shown in FIG. 2, two pairs superposed above another two pairs, with the upper two pairs of fingers 36 closed, the lower two pairs open, but only for purposes of illustration. In a practical embodiment, all the fingers 36 open and close together, as do the beller jaw fingers 30.

A practical embodiment of this invention is shown in greater detail with reference to FIGS. 4–7 of the Drawing.

In this embodiment a support frame 50 (shown in ghost line in FIGS. 4 and 5 and in solid lines in FIG. 6) supports belling gripper fingers 52 which are swingably mounted thereon by pivot pins 54 and expander gripper fingers 56 which are mounted thereon by associated pivot pins 54. Adjacent to the belling and expanding mechanism is mounted a work piece, namely a partially formed plate-fin heat exchanger 58, formed of a plurality of U-tubes or hairpin tubes 60 disposed with open ends 62 facing the device.

The plate-fin heat exchanger is formed of a stack of fin plates 64 sandwiched between tube sheets 66. The U-tubes or hairpin tubes 60 are laced through fin collars in the fin plates and tube sheets. Bells 68 are formed at the tube ends 62 at a predetermined standoff or offset distance 70 from the adjacent tube sheet 66. The bells 68 serve as female members to receive the return bends that connect one hairpin tube to another, and also have flared tips which assist in insertion of the return bends, in the brazing process, and in gripping of the tubes during expansion.

Figure 6:
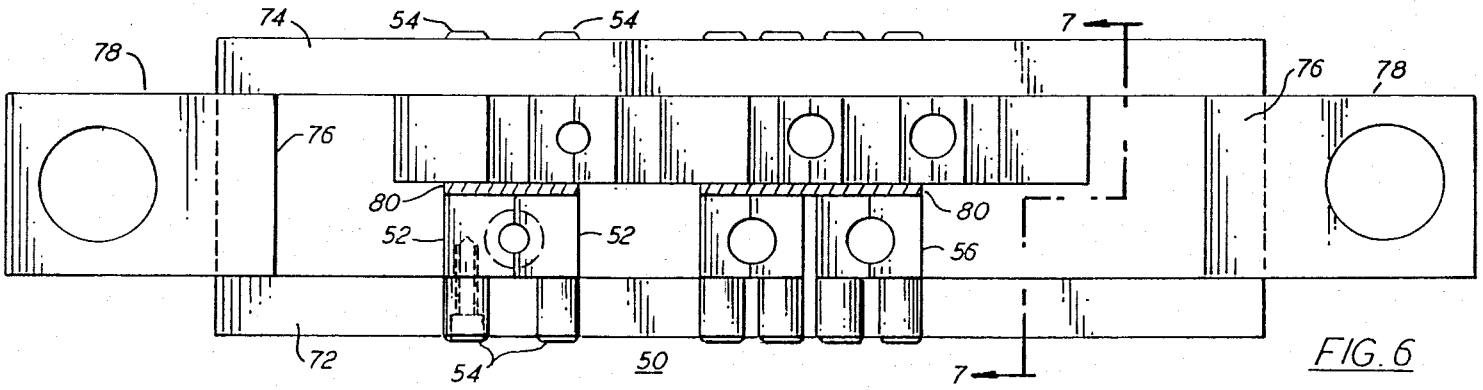
FIG. 6 is a front sectional elevation at line 6—6 of FIG. 5.

As shown in FIG. 6, the support frame 50 is made up of a transverse base plate 72 and an upper plate 74 connected to it by end members 76. The upper plate 74 is easily removed for changing the belling and expanding gripper fingers 52, 56. Mounts 78 are disposed at the end members 76 and connect it to a displacer mechanism (not shown) for moving the frame horizontally and vertically, as well as towards and away from the fin pack heat exchanger 58. Also shown in FIG. 6 are spacers 80 installed between the superposed pairs of belling gripper fingers 52 and between the pairs of expander gripper fingers 56. In the configuration illustrated in FIG. 6, the fingers are set so as to match a spacing ratio, i.e. the ratio of vertical spacing between rows of tube ends 62 to the horizontal spacing within a row between successive tube ends 62. Here, the ratio is established at 0.866. However, the spacers 80 can be moved to the position shown in ghost lines, that is, below the lower sets of the fingers 52 and 56, to match different spacing ratios.

Figure 4:
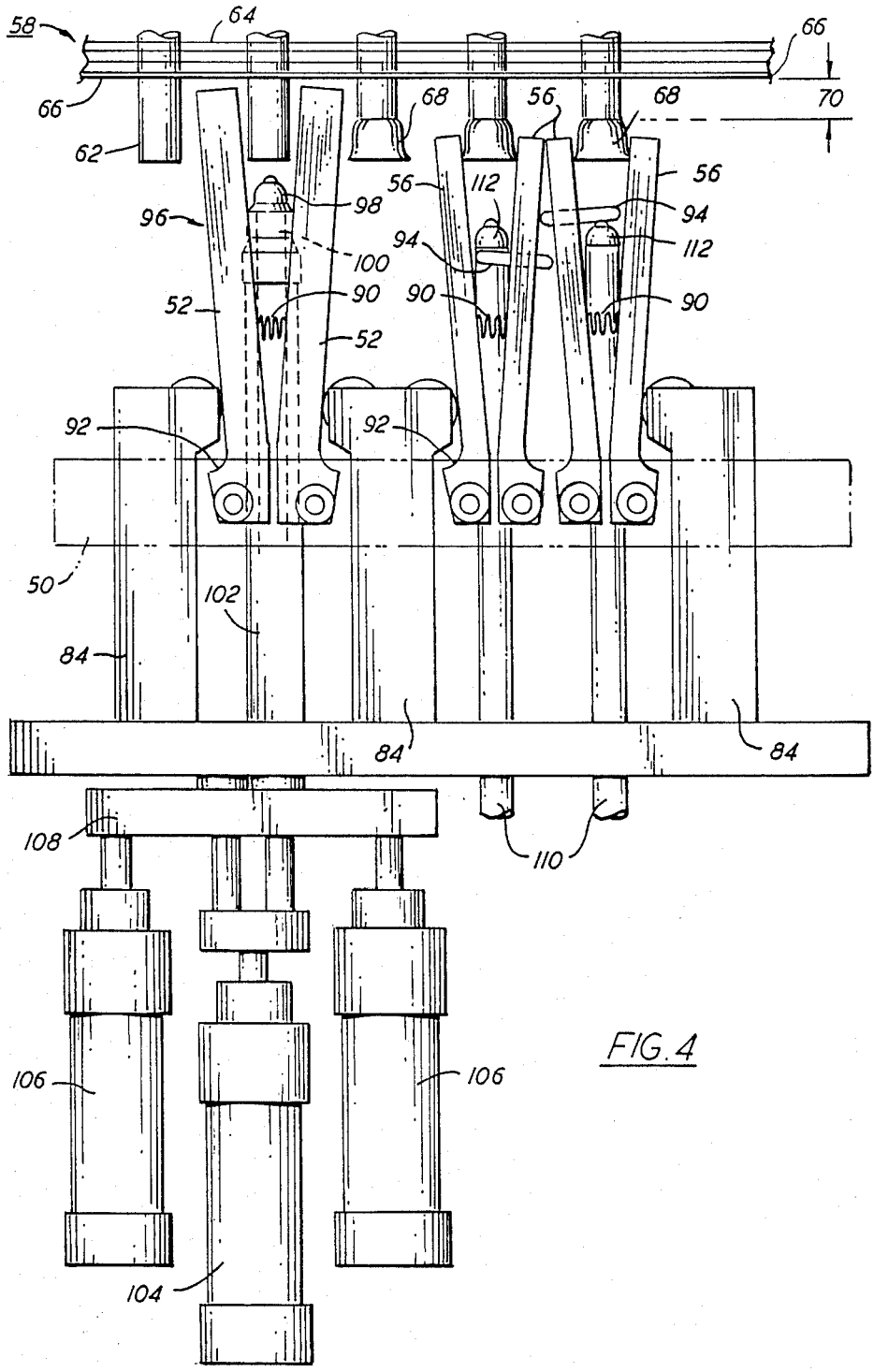
FIG. 4 is a detailed top plan view of apparatus embodying this invention showing the belling and expanding gripping devices in an open position.
Figure 5:
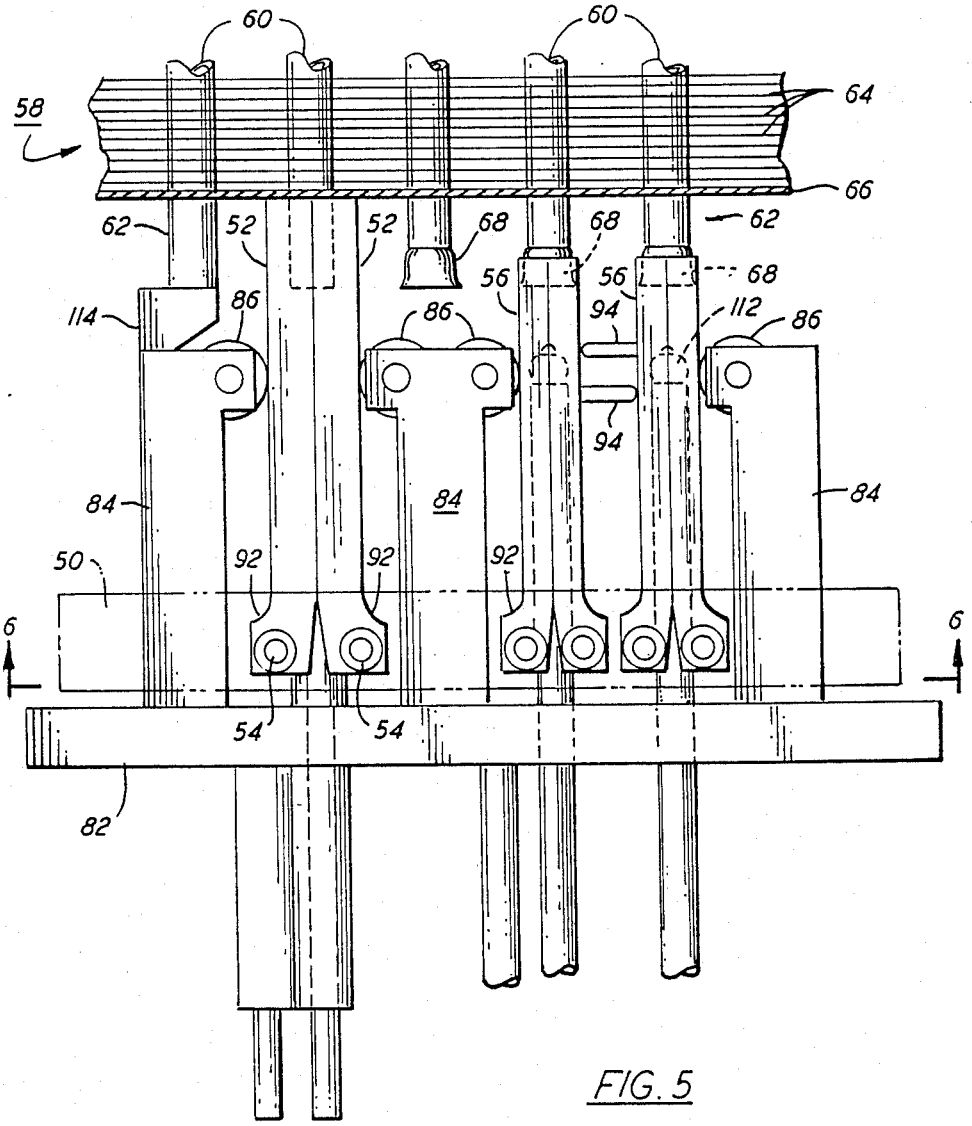
FIG. 5 is a detailed top plan view as in FIG. 4, but showing the gripping devices in a closed position.
Figure 7:
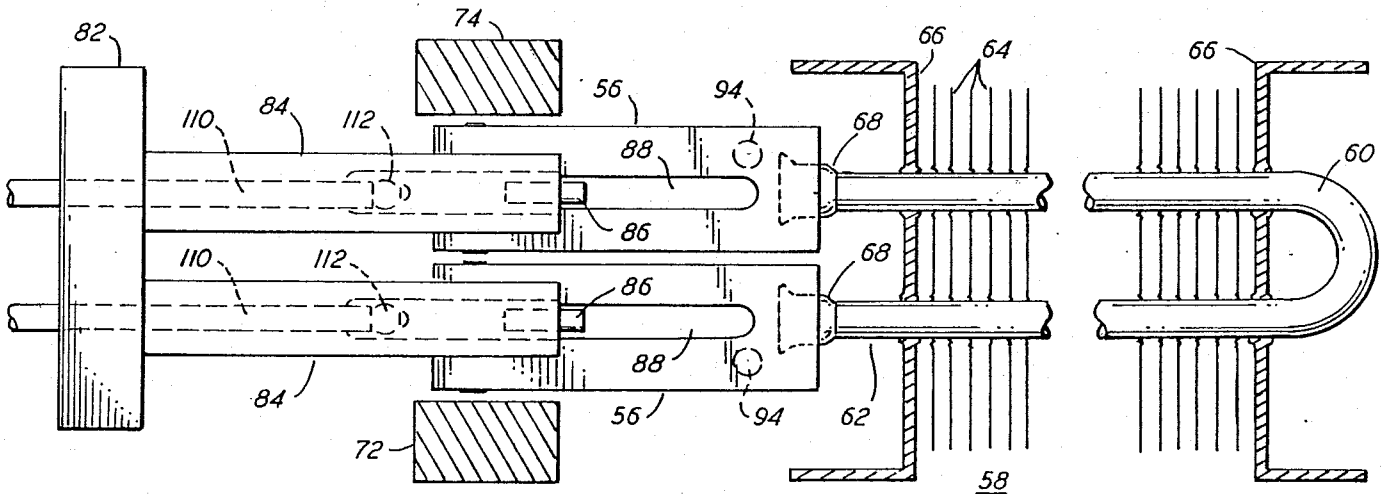
FIG. 7 is a side sectional elevation at line 7—7 of FIG. 6.

A cam arrangement for closing the fingers 52 and 56 is shown in FIGS. 4, 5, and 7. A cam actuator plate 82 moves in the axial direction of the hairpin tubes, that is, up and down in the Drawing. On this plate 82 there are mounted a plurality of camming bars 84 which extend towards the tube sheet 66. These bars 84 each carry one or more roller bearings 86 at their distal ends. The roller bearings 86 ride in camways 88 (see FIG. 7) formed along outer surfaces of the belling gripper fingers 52 and along outer surfaces of the expander gripper fingers 56. The cam actuator plate 82, camming bars 84, and roller bearings 86 clamp the fingers 52 and 56 closed over the associated tube ends 62 when they are actuated distally, as shown in FIG. 5, and release the fingers 52 and 56 to open when moved to the proximal position as shown in FIG. 4. In this embodiment there are springs 90 which bias the fingers 52 and 56 apart to urge them open. Also, the camways of the fingers 52,56 each have a curved proximal end 92 to urge the fingers open by action of the roller bearings when the same are moved fully back.

As also shown in FIGS. 4 and 5, there are a number of push rods or connecting pins 94 which extend through interior ones of the expander jaw fingers 56. These connect the corresponding expander jaw fingers in adjacent pairs thereof to apply a closing force to the inner ones of the two pairs of fingers 56 when the cam actuator and cam rollers close over the outer fingers 56. That is, one of these connecting pins 94 connects the corresponding left fingers of the two pairs while the other connecting pin 94 connects the right fingers of the two pairs. In the limited geometry available for the expander jaw fingers 56, the cam roller bearings 86 can act only on the outer ones of the four expander fingers of a given row. The use of these connecting pins 94 permits these jaws to open and close securely without requiring significant additional hardware.

As also shown in FIG. 4, a belling device 96 comprises a pinch bullet 98 that is mounted on the distal end of an inner rod, and a belling collar 100 mounted on the distal end of an outer rod 102. The inner and outer rods are moved by actuators 104 and 106 for successively urging the pinch bullet 98 and the collar 100 forward. In this case, there are a pair of belling collar actuators 106 which are connected to the outer rod 102 by means of an actuator plate 108. When the belling gripper fingers 52 are clamped together by means of the cam actuator plate and camming roller bearings 86, as illustrated in FIG. 5, the tube end is expanded by inserting the pinch bullet 98 into the tube end 62. Then, the flared end portion of the bell is formed by ramming the outer actuator and the belling collar 100 forward. After this, the belling device 96 is retracted and the belling gripping fingers are opened.

In this embodiment, there are provided a set of expander rods 110 for each of the respective pairs of expander gripper fingers 56. As shown in FIG. 5, each of these rods carries an expander bullet 112 at its distal end. Selected ones of these expander rods 110 are driven forward through the hairpin tubes while the fingers 56 are held closed, as shown in FIG. 5, to restrain the tubes 60 against axial movement.

Also shown in FIG. 5 is a hairpin setter 114 which pushes against the outer end of the unbelled hairpin tubes 60 to preset the tube ends approximately to the predetermined standoff distance prior to the belling and expansion operations. The setter 114 acts on the next-in-turn tube ends to preset them just prior to the belling operation.

While the specific embodiment that has been illustrated to serve as an example, it should be apparent that many other configurations of this device could be constructed according to the principles of this invention. For example, the belling and expansion could take place along a single row of tubes, or could take place along three or more rows simultaneously. Also, the belling and expander gripper fingers 62 and 66 can be replaced with other suitable gripper fingers so as to accommodate hairpin tubes of different diameters, or of different materials.

The apparatus of this invention can be programmed in advance and can be computer controlled to identify the tube ends corresponding to each hairpin tube so as to actuate the correct expander rods 110 at the appropriate times.

The present invention has been described with respect to a preferred embodiment, but it should be recognized that the invention is not limited to that precise embodiment. Rather, many modifications and variations would present themselves to those of skill in the art without departing from the scope and spirit of this invention, as defined in the appended claims.

What is claimed is:

1. Apparatus for expanding tubes into a plate-fin heat exchanger unit in which there are a plurality of hairpin tubes passing through aligned opening in a fin pack that is formed of a stack of fin plates sandwiched between two tube sheets, each said hairpin tube comprising a U-bend joining a pair of parallel legs with open ends of the legs extending beyond one of the tube sheet and lying in rows, said one of the tube sheets having a forward-facing flange that extends over said open ends, the apparatus comprising:

a frame;

means supporting said fin pack with the open ends of the tubes facing said frame;

at least one pair of elongated belling jaw fingers swingably mounted on said frame to reach beneath said forward-facing flange and clamp and clamp over an associated end of said hairpin tubes, the belling jaw fingers having a profile surface permitting expansion of said tube end to a bell shape;

means for urging said belling jaw fingers closed over said tube end during a belling operation;

means for urging said belling jaw fingers open after the belling operation has been carried out;

belling means carried on said frame and insertable into the associated tube end between said belling jaw fingers when the latter are closed for urging the tube outward into said profile to bell the end thereof;

a plurality of pairs of elongated expander jaw fingers swingably mounted on said frame to reach beneath said forward-facing flange and clamp over the belled ends of adjacent legs of the hairpin tubes in at least two rows;

means for closing said expander jaw fingers over the associated belled tube ends to grip the same during an expansion operation at a predetermined standoff in advance of said tube sheet;

means for urging said expander jaw fingers open after said expansion operation;

a plurality of expander rods, each associated with one of said pairs of expander jaw fingers, carried on said frame and drivable between the associated expander jaw fingers into the associated tube legs to urge the tube legs radially outward into contact against the fin plate and tube sheets; and means for stepping said frame and said belling and expander jaw fingers laterally to a work position corresponding to positions of next adjacent tube ends with respect to said fin pack for belling an adjacent tube end and expanding at least one other pair of belled tube legs while at said work position.

2. Tube expanding apparatus according to claim 1 wherein said belling jaw fingers and said expander jaw fingers open and close laterally in the direction of said rows.

3. Tube expanding apparatus according to claim 1 wherein there are two of said pairs of belling jaw fingers and an associated two belling means, said two pairs being superposed on said frame to traverse successive rows of said tube ends.

4. Tube expanding apparatus according to claim 1 wherein there are two pairs of said expander jaw fingers and an associated two expander rods arranged side by side to grasp and expand either or both of a pair of tube legs in one row, and another two pairs of said expander jaw fingers and an associated two expander rods arranged side by side and superposed at an adjacent row to grasp and expand either or both of a pair of tube legs in said adjacent row.

5. Tube expanding apparatus for expanding tubes into a plate-fin heat exchanger unit in which there are a plurality of hairpin tubes passing through aligned openings in a fin pack that is formed of a stack of fin plate sandwiched between two tube sheets, each said hairpin tube comprising a U-bend joining a pair of parallel legs with open ends of the legs extending beyond one of the tube sheets and lying in rows, the apparatus comprising:

a frame;

means supporting said fin pack with the open ends of the tubes facing said frame;

at least one pair of belling jaw fingers swingably mounted on said frame to clamp over an associated end of said hairpin tubes, the belling jaw fingers having a profile surface permitting expansion of said tube end to a bell shape;

means for urging said belling jaw fingers closed over said tube end during a belling operation;

means for urging said belling jaw fingers open after the belling operation has been carried out;

belling means carried on said frame and insertable into the associated tube end between said belling jaw fingers when the latter are closed for urging the tube outward into said profile to bell the ends thereof;

a plurality of pairs of expander jaw fingers swingably mounted on said frame to clamp over the belled ends of adjacent legs of the hairpin tubes in at least two rows;

means for closing said expander jaw fingers over the associated belled tube ends to grip the same during an expansion operation;

means for urging said expander jaw fingers open after said expansion operation;

a plurality of expander rods, each associated with one of said pairs of expander jaw fingers, carried on said frame and drivable between the associated expander jaw fingers into the associated tube legs to urge the tube legs radially outwardly into contact against the fin plates and tube sheets; and means for stepping said frame and belling and expander jaw fingers laterally with respect to said fin pack to a work position for belling an adjacent tube end and expanding at least one other pair of belled tube legs to a work position;

wherein there are two pairs of said expander jaw fingers and associated two expander rods arranged side by side to grasp and expand either or both of a pair of tube legs in one row, and another tow pairs of said expander jaw fingers and an associated two expander rods arranged side by side and superposed at an adjacent row to grasp and expand either or both of a pair of tube legs in said adjacent row, and wherein said means for closing said expander jaw fingers includes a cam actuator which moves forward towards said fin pack heat exchanger to close the same; a plurality of cam rollers carried by said cam actuator and disposed at outer sides of outer ones of said two pairs of expander fingers for each said row; camways formed along the outer sides of said outer ones of said fingers in which said cam rollers travel for urging the outer fingers towards one another when said cam actuator moves forward; and a plurality of push rods for operatively connecting corresponding expander jaw fingers in adjacent pairs thereof to apply a closing force to inner ones of said two pairs of jaw fingers when said can actuator and said cam rollers close the outer ones thereof.

6. Tube expanding apparatus for expanding tubes into a plane-fin heat exchanger unit in which there are a plurality of hairpin tubes passing through aligned openings in a fin pack that is formed of a stack of fin plates sandwiched between two tube sheets, each said hairpin tube comprising a U-bend joining a pair of parallel legs with open ends of the legs extending beyond one of the tube sheets and lying in rows, the apparatus comprising:

a frame;

means supporting said fin pack with the open ends of the tubes facing said frame;

at least one pair of belling jaw fingers swingably mounted on said frame to clamp over an associated end of said hairpin tubes, the belling jaw fingers having a profile surface permitting expansion of said tube end to a bell shape;

means for urging said belling jaw fingers closed over said tube end during a belling operation;

means for urging said belling jaw fingers open after the belling operation has been carried out;

belling means carried on said frame and insertable into the associated tube end between said belling jaw fingers when the latter are closed for urging the tube outward into said profile to bell the end thereof;

a plurality of pairs of expander jaw fingers swingably mounted on said frame to clamp over the belled ends of adjacent legs of the hairpin tubes in at least two rows;

means for closing said expander jaw fingers over the associated belled tube ends to grip the same during an expansion operation;

means for urging said expander jaw fingers open after said expansion operation;

a plurality of expander rods, each associated with one of said pairs of expander jaw fingers, carried on said frame and drivable between the associated expander jaw fingers into the associated tube legs to urge the tube legs radially outward into contact against the fin plate and tube sheets; and means for stepping said frame and said belling and expander jaw fingers laterally with respect to said fin pack to a work position for belling an adjacent tube end and expanding at least one another pair of belled tube legs while at said work position;

in which there are two pairs of said expander jaw fingers and an associated two expander rods arranged side by side to grasp and expand either or both of a pair of tube legs in one row, and another two pairs of said expander jaw fingers and an associated two expander rods arranged side by side and superposed at an adjacent row to rasp and expand either or both of a pair of tube legs in said adjacent row; and in which said frame includes an upper plate and a lower plate between which there are supported an upper set of the expander jaw fingers and a lower set of the expander jaw fingers, with a movable spacer being interposed in one configuration between the upper and lower sets of expander jaw fingers and in another configuration between the lower set of the expander jaw fingers and the lower plate of said frame.

* * * * *

UNITED STATES PATENT AND TRADEMARK OFFICE

CERTIFICATE OF CORRECTION

PATENT NO. : 4,858,305

DATED : August 22, 1989

INVENTOR(S) : Kenneth P. Gray et al.

It is certified that error appears in the above-identified patent and that said Letters Patent is hereby corrected as shown below:

Col. 6, line 68, please delete first occurrence of "and clamp".

Col. 8, line 36, please change "tow" to --two--;

line 56, please change "can" to --cam--.

Col. 10, line 14, please change "rasp" to --grasp--.

Signed and Sealed this

Second Day of October, 1990

*Attest:*

HARRY F. MANBECK, JR.

*Attesting Officer*

*Commissioner of Patents and Trademarks*